US006684922B1

(12) United States Patent
Alston et al.

(10) Patent No.: US 6,684,922 B1
(45) Date of Patent: Feb. 3, 2004

(54) CONTAINER DRAINER HOLDER

(76) Inventors: Shirley M.C. Alston, 7347 Furnace Branch Rd., Glen Burnie, MD (US) 21060; Raymond E. Carter, 7347 Furnace Branch Rd., Glen Burnie, MD (US) 21060

( * ) Notice: Subject to any disclaimer, the term of this patent is extended or adjusted under 35 U.S.C. 154(b) by 0 days.

(21) Appl. No.: 10/210,999

(22) Filed: Aug. 1, 2002

(51) Int. Cl.[7] ..... B67C 9/00

(52) U.S. Cl. ..... 141/375; 141/364; 211/74; 211/85; 248/145.3; 248/146; 248/150; 248/311.3; 222/181.1; 222/185.1

(58) Field of Search ..... 141/319, 364, 141/375; 211/74, 85; 248/145.3, 146, 150, 311.3; 222/181.1, 185.1

(56) References Cited

U.S. PATENT DOCUMENTS 928,213 A * 7/1909 Patterson ..... 248/121
959,772 A * 5/1910 Maney ..... 211/74
1,763,130 A * 6/1930 Cartwright ..... 248/146
2,018,929 A * 10/1935 Stillman et al. ..... 141/319
2,791,391 A * 5/1957 Uphoff ..... 248/150
2,861,764 A * 11/1958 Fisher ..... 248/146
3,049,137 A * 8/1962 Cole ..... 134/152
3,169,742 A * 2/1965 Smith ..... 248/146
4,347,879 A * 9/1982 Blaser ..... 141/364
4,454,897 A * 6/1984 Valiant ..... 141/364
4,678,149 A * 7/1987 Chase ..... 248/150
5,971,220 A * 10/1999 Payne ..... 222/185.1
5,996,947 A * 12/1999 Palmieri, III ..... 248/146

* cited by examiner

*Primary Examiner*—J. Casimer Jacyna
(74) *Attorney, Agent, or Firm*—Larry J. Guffey

(57) ABSTRACT

A holder for draining a viscous fluid from a bottle, of the type having a neck and a mouth, is disclosed. This holder comprises a base having an outer perimeter, a plurality of elongated, support members that extend from the base's outer perimeter and are foldable upward so that their ends approach each other at a point on an axis which extends perpendicular to the bottom of the base. The ends of the support members are flared and concaved outward so that these portion cooperate to form a structure, when the support members are folded upward, for receiving the neck of a bottle that is inverted and placed in the holder. The members are held in their upward folded positions by an elastic band which is placed around the outside of the support members in the vicinity of their concave outward portions.

20 Claims, 4 Drawing Sheets

CONTAINER DRAINER HOLDER

BACKGROUND OF THE INVENTION

1. Field of Invention

The present invention generally relates to fluent material handling equipment. More particularly, this invention relates to a holder for draining a viscous fluid from a bottle of the type having a neck and a mouth.

2. Description of the Related Art

Various devices have previously been proposed for draining viscous fluids from bottles. One type of prior art device is in the form of a rack or stand that holds a bottle to be emptied in an inclined position. For example, see U.S. Pat. Nos. 3,814,293, 3,872,868, 4,278,225, 5,002,246, and 5,080,150.

A problem with these types of device is that they are often limited in the size of bottles that they can accommodate. Additionally, when their use is only occasionally needed, they are often sized such that they are inconvenient to store. Furthermore, these devices can often be relatively complicated or elaborate structures, which is often reflected in the prices charged for them.

U.S. Pat. No. 4,399,847 accommodates a large range of bottle sizes by providing a support member which is extended into the mouth of an inverted bottle, with the bottle being supported by having the inside surface of the bottle's bottom rest on the tip of this support member. A disadvantage of this device is the potential that exists for the support member to contaminate the bottle's contents.

Despite the prior art, there exists a need for a better means for draining viscous fluids from bottles. Such a means would preferably have improved qualities such as: (1) simpler construction, leading to lower costs, (2) capability to accommodate a wider range of bottle sizes, and (3) ease of use and storage when not in use.

3. Objects and Advantages

There has been summarized above, rather broadly, the prior art that is related to the present invention in order that the context of the present invention may be better understood and appreciated. In this regard, it is instructive to also consider the objects and advantages of the present invention.

It is an object of the present invention to provide a container drainer holder that is of a very simple construction so that it can easily be manufactured and sold less expensively than competitive products.

It is another object of the present invention to provide a container drainer holder that can accommodate a wide range of bottle sizes.

It is still another object of the present invention to provide a container drainer holder that will allow one bottle to be held in an inverted position while its contents are drained into another bottle.

It is a further object of the present invention to provide a container drainer holder that is easy and convenient to store when not in use.

These and other objects and advantages of the present invention will become readily apparent as the invention is better understood by reference to the accompanying drawings and the detailed description that follows.

SUMMARY OF THE INVENTION

In accordance with one preferred embodiment of the present invention, a holder for draining a viscous fluid from a bottle, of the type having a neck and a mouth, comprises a central base having an outer perimeter, a plurality of elongated, support members that extend from the base's outer perimeter and are foldable upward so that their ends approach each other at a point on an axis which extends perpendicular to and above this base. The ends of the support members are flared and concaved outward so that these portions cooperate to form a structure, when the support members are folded upward, for receiving the neck of a bottle that is inverted and placed in the holder. The members are held in their upward folded positions by an elastic band which is placed around the outside of the support members in the vicinity of their concave outward portions.

Other embodiments of the present invention have features which allow this holder to be placed onto the neck of a second bottle into which the contents of the first bottle is to be drained, and features which limit the inward, angular extent to which the support members may be bent.

Thus, there has been summarized above, rather broadly, the more important features of the present invention in order that the detailed description that follows may be better understood and appreciated. There are, of course, additional features of the invention that will be described hereinafter and which will form the subject matter of any eventual claims to this invention.

DESCRIPTION OF THE PREFERRED EMBODIMENT

Figure 1:
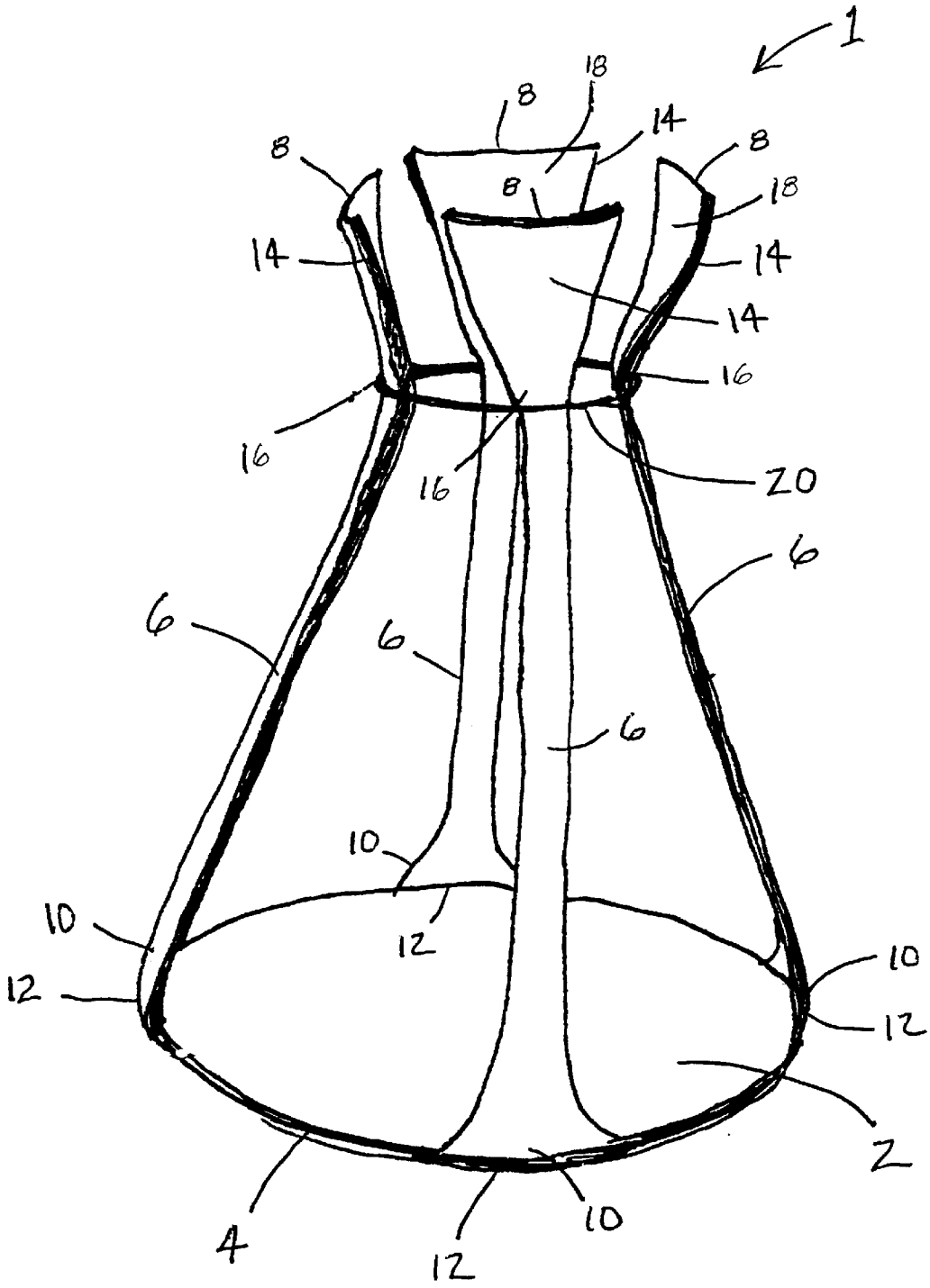
FIG. 1 is a perspective view of a preferred embodiment of the present invention wherein its support members have been folded upward and held in place by an elastic band.

Referring now to the drawings wherein are shown preferred embodiments and wherein like reference numerals designate like elements throughout, there is shown in FIG. 1 an embodiment of the present invention.

This holder 1 for draining a viscous fluid from a bottle is seen to include a flat, circular base 2 which has an outer perimeter 4. From this perimeter, there extend four elongated, support members 6, each of which has a distal end 8 and an end 10 that is connected by a hinging means 12 to the base's outer perimeter 4.

These hinging means 12, such as an actual hinge or merely a crease in the base material at its perimeter, allow each support member 6 to be folded upward from the base 2 so that the distal ends 8 approach each other at a point which lies approximately on a vertical axis that extends perpendicular to and above the base. Near their distal ends, these support members have a wider portion 14. At the bottom of these portions 14 where their width begin to increase 16, so as to yield the wider portions, these support members 6 are bent backward or flared outward so that their distal ends 8 are further from the vertical axis extending from the base than the members 6 are in the vicinity of where their widths increase 16. The inner sides of these flared portions serve effectively as a pad 18 or support surface upon which the neck of a bottle can rest when the bottle is inverted and placed in the holder 1.

In the region of their distal ends, each of the support members 6 has concave curvature that extends along the widths of the members. This concave curvature allows the wider, flared portions 14 to extend so that their distal ends, when the support members 6 are folded upward, lie in a plane that is approximately parallel to the plane defined by the bottom of the base 2.

Furthermore, when so folded, the distal ends 8 of these members are configured so that they effectively define line segments which partially makeup a circle that lies in this parallel plane above the base. The shaping of the members' distal ends in this manner results in an effective structure being formed for receiving the neck of those bottles whose exterior surfaces are curved about an axis extending from the top to the bottom of such bottles.

The folded upward support members are held in position by an elastic band 20, or other suitable means, which is placed around the outside of the support members 6 in the vicinity of their concave outward portions. The use of this elastic band 20 allows the cooperating support members to accommodate a wide range of bottle sizes.

Figure 2:
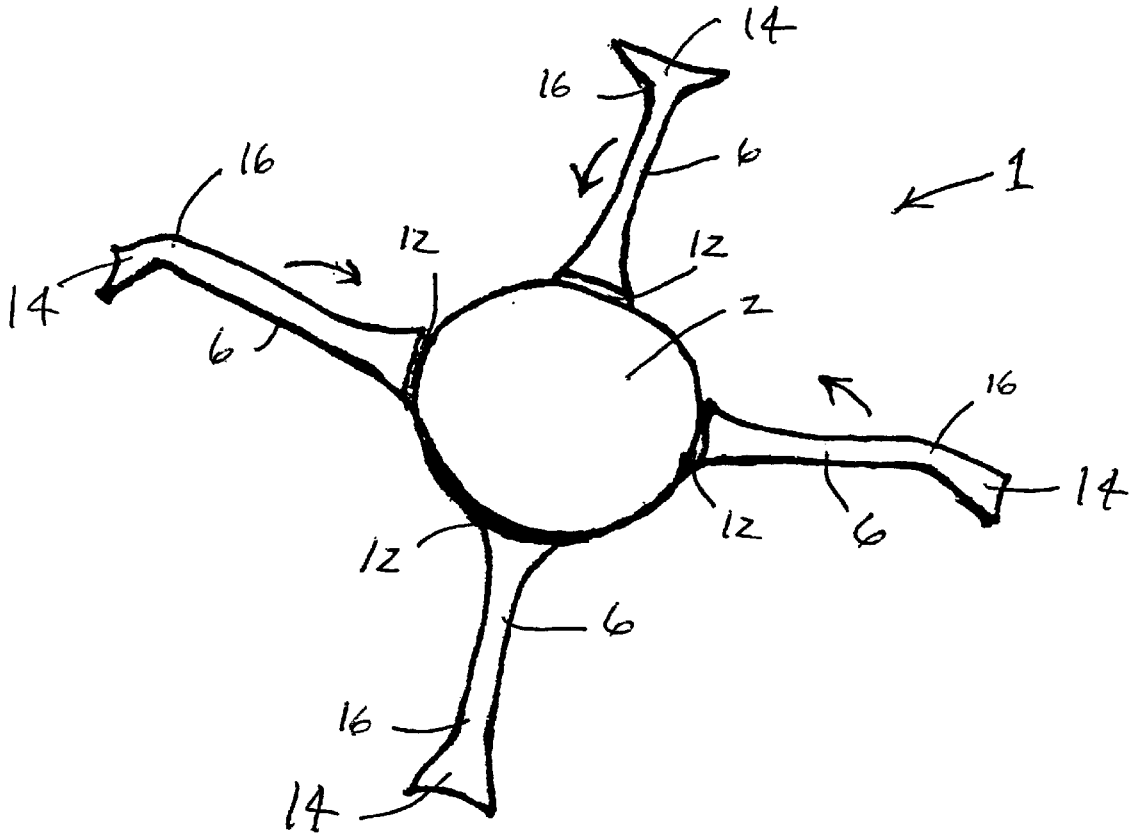
FIG. 2 is a perspective view of this same embodiment when its support members are not folded upward.

FIG. 2 provides a perspective view of this same embodiment when its support members 6 are not folded upward so that the device assumes a relatively one-dimensional shape for ease of storage when the device is not in use.

Figure 3:
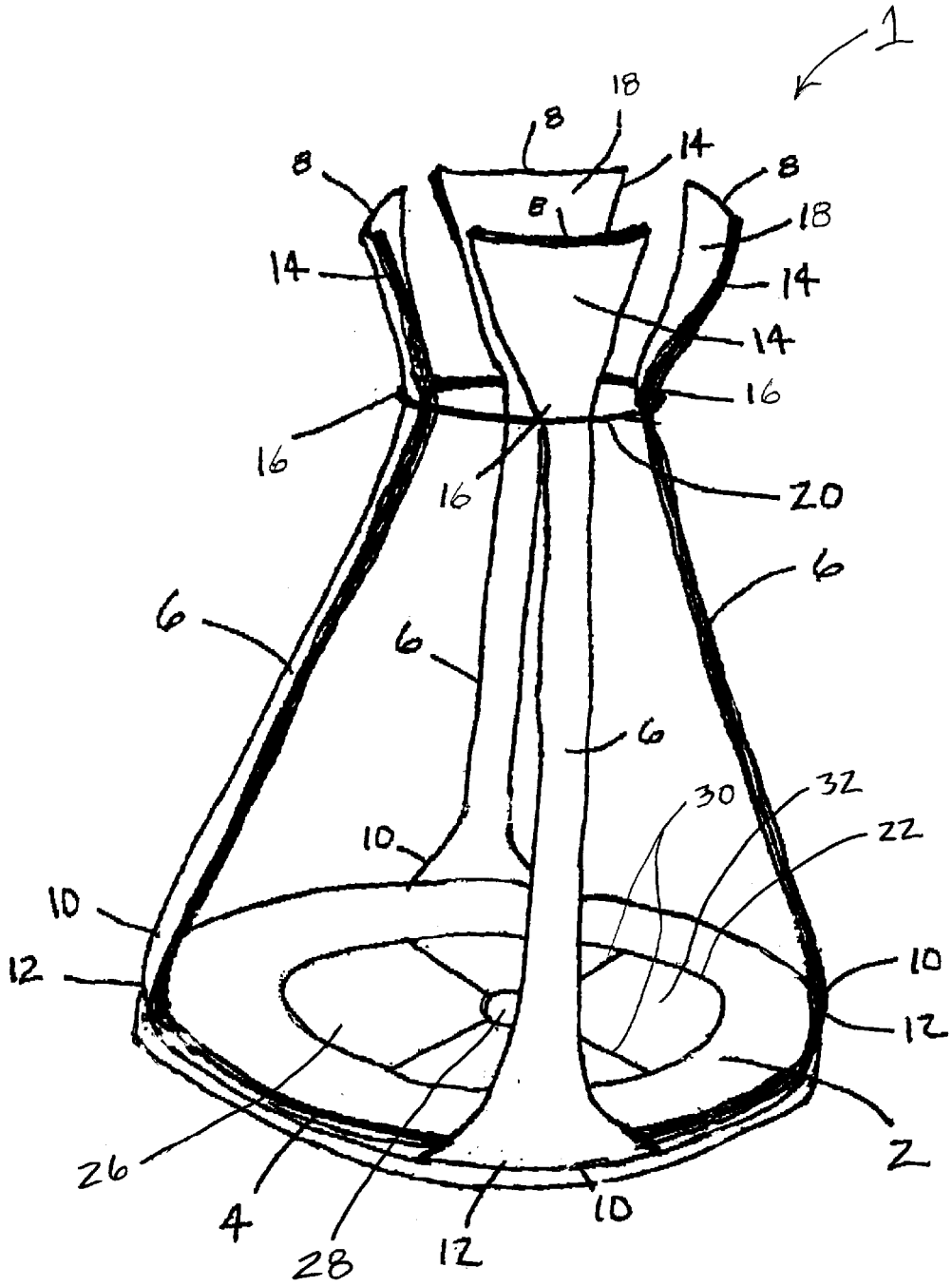
FIG. 3 is a perspective view of an embodiment having a pliable member attached to the base's bottom and with its support members folded upward and held in place by an elastic band.

In another embodiment of the present invention, the circular base 2 of the holder 1 has an a circular opening 22 at its center. Beneath the base's bottom 24 and covering the area created by the opening 22 in the base 2 is attached a flat, pliable membrane 26. This membrane also has an opening 28 at its center. Extending radially from this opening 28 are several slits 30 in the membrane which allow the portions 32 of the membrane between these slits to be bent either upward. Rubber gasketing material having a thickness in the range of 1/16–1/8 inches has been found to be suitable material from which to construct this membrane. The addition of such a membrane to the base's bottom 24 allows the holder 1 to be placed on the top of the neck of a second bottle in which it is desired to drain the contents of the first bottle. The neck of the second bottle is inserted in the pliable membrane's opening 28 and the portions 32 of the membrane between the slits 30 are bent upward so as to from a collar around the neck of the second bottle. See FIG. 3.

Figure 4:
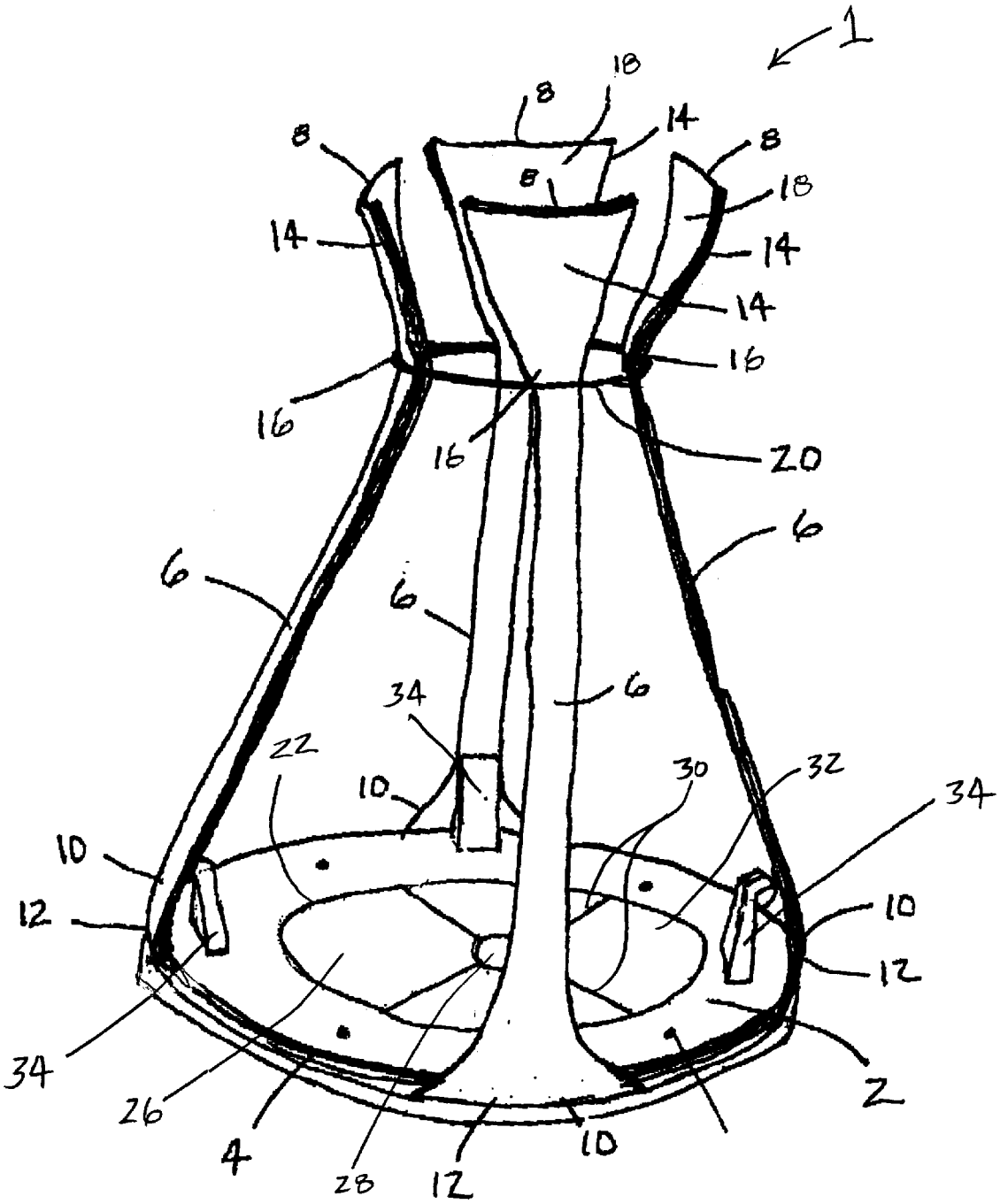
FIG. 4 is a perspective view of the embodiment shown in FIG. 3 and which also has stops which limit the support members inward angular extension.

In another embodiment, a wedge shaped block 34 is added to the top of the base and positioned just inside the hinging means 12 so as act as a stop which limits the angular extent to which the members can be bent inward toward the vertical axis extending from the base's center. See FIG. 4.

A wide arrangement of materials can be used from which to make the device, depending on the relative physical characteristics (e.g., plastic to allow the device to withstand various chemicals and harsh environments, cardboard to minimize the device's cost) desired for the device. Additionally, it is envisioned that the device could be provided in a wide range of exterior colors so as to color-coordinate the device with its eventual surroundings.

Although the foregoing disclosure relates to a preferred embodiment of the invention, it is understood that these details have been given for the purposes of clarification only. Various changes and modifications of the invention will be apparent, to one having ordinary skill in the art, without departing from the spirit and scope of the present invention.

We claim:

1. A holder for draining a viscous fluid from a bottle having a neck and a mouth, said holder comprising:

a base having a flat bottom surface and an outer perimeter, a plurality of elongated, support members, each of which has a distal end and an end that is connected at a contact point along said base outer perimeter, a means for hinging located at said member contacts points with base outer perimeter so as to allow each said member to be folded upward about its contact point with said base so that said distal ends approach each other at a point on a vertical axis that extends perpendicular to and above the plane defined by the bottom of said base, and a means for holding said distal ends in their hinged upward position so to enable said distal ends to form a structure for receiving the neck of said bottle when said bottle is inverted and placed in said holder.

2. A holder as recited in claim 1, wherein:

said support members proximate their distal ends having concave curvature that extends along the widths of said members so as to configure said distal ends for receiving the neck of those bottles whose exterior surfaces are curved about an axis extending from the top to the bottom of said bottles.

3. A holder as recited in claim 2, wherein:

the width of said support members proximate their distal ends being larger than at other points along the length of said member as to form a larger surface area for receiving the neck of a bottle that is inverted and placed in said holder.

4. A holder as recited in claim 3, wherein:

said support members proximate their distal ends being bent backward so as to flare outward their distal ends.

5. A holder as recited in claim 3, further comprising:

said base having an opening at the center of said base, and a pliable membrane attached to the bottom of said base and extending so as to approximately cover said base opening, said membrane having an opening at its center, said membrane opening having a perimeter edge, said membrane having a plurality of radially extending slits in said membrane that extend inward from the said perimeter edge of said membrane opening.

6. A holder as recited in claim 6, further comprising:

a plurality of means for limiting the angular extent to which a support member can be bent inward towards a vertical axis extending from the center of said base, one of each said limiting means being located on the top of said base and proximate said member contact point with said base.

7. A holder as recited in claim 2, wherein:

said support members proximate their distal ends being bent backward so as to flare outward their distal ends.

8. A holder as recited in claim 2, further comprising:

said base having an opening at the center of said base, and a pliable membrane attached to the bottom of said base and extending so as to approximately cover said base opening, said membrane having an opening at its center, said membrane opening having a perimeter edge, said membrane having a plurality of radially extending slits in said membrane that extend inward from the said perimeter edge of said membrane opening.

9. A holder as recited in claim 2, further comprising:

a plurality of means for limiting the angular extent to which a support member can be bent inward towards a vertical axis extending from the center of said base, one of each said limiting means being located on the top of said base and proximate said member contact point with said base.

10. A holder as recited in claim 1, wherein:

the width of said support members proximate their distal ends being larger than at other points along the length of said member as to form a larger surface area for receiving the neck of a bottle that is inverted and placed in said holder.

11. A holder as recited in claim 10, wherein:

said support members proximate their distal ends being bent backward so as to flare outward their distal ends.

12. A holder as recited in claim 10, further comprising:

said base having an opening at the center of said base, and a pliable membrane attached to the bottom of said base and extending so as to approximately cover said base opening, said membrane having an opening at its center, said membrane opening having a perimeter edge, said membrane having a plurality of radially extending slits in said membrane that extend inward from the said perimeter edge of said membrane opening.

13. A holder as recited in claim 10, further comprising:

a plurality of means for limiting the angular extent to which a support member can be bent inward towards a vertical axis extending from the center of said base, one of each said limiting means being located on the top of said base and proximate said member contact point with said base.

14. A holder as recited in claim 1, wherein:

said support members proximate their distal ends being bent backward so as to flare outward their distal ends.

15. A holder as recited in claim 14, further comprising:

said base having an opening at the center of said base, and a pliable membrane attached to the bottom of said base and extending so as to approximately cover said base opening, said membrane having an opening at its center, said membrane opening having a perimeter edge, said membrane having a plurality of radially extending slits in said membrane that extend inward from the said perimeter edge of said membrane opening.

16. A holder as recited in claim 15, further comprising:

a plurality of means for limiting the angular extent to which a support member can be bent inward towards a vertical axis extending from the center of said base, one of each said limiting means being located on the top of said base and proximate said member contact point with said base.

17. A holder as recited in claim 14, further comprising:

a plurality of means for limiting the angular extent to which a support member can be bent inward towards a vertical axis extending from the center of said base, one of each said limiting means being located on the top of said base and proximate said member contact point with said base.

18. A holder as recited in claim 1, further comprising:

said base having an opening at the center of said base, and a pliable membrane attached to the bottom of said base and extending so as to approximately cover said base opening, said membrane having an opening at its center, said membrane opening having a perimeter edge, said membrane having a plurality of radially extending slits in said membrane that extend inward from the said perimeter edge of said membrane opening.

19. A holder as recited in claim 18, further comprising:

a plurality of means for limiting the angular extent to which a support member can be bent inward towards a vertical axis extending from the center of said base, one of each said limiting means being located on the top of said base and proximate said member contact point with said base.

20. A holder as recited in claim 1, further comprising:

a plurality of means for limiting the angular extent to which a support member can be bent inward towards a vertical axis extending from the center of said base, one of each said limiting means being located on the top of said base and proximate said member contact point with said base.

* * * * *